United States Patent [19]

Grosshauser

[11] 4,325,301

[45] Apr. 20, 1982

[54] PAPER WEB SHIFTING APPARATUS

[75] Inventor: Heinrich K. Grosshauser, Wurzburg, Fed. Rep. of Germany

[73] Assignee: Koenig & Bauer AG, Wurzburg, Fed. Rep. of Germany

[21] Appl. No.: 167,100

[22] Filed: Jul. 8, 1980

[30] Foreign Application Priority Data

Aug. 8, 1979 [DE] Fed. Rep. of Germany ..... 2932087

[51] Int. Cl.[3] ..... B41F 7/02; B41F 13/54; E04G 3/00

[52] U.S. Cl. ..... 101/217; 101/225; 101/228; 182/91

[58] Field of Search ..... 101/156, 153, 135, 136, 101/137, 138, 173, 174, 175, 176, 177, 178, 179, 180, 181, 216, 217, 218, 219, 220, 221, 222, 223, 224, 225, 226, 227, 228, 229; 226/91, 189; 68/244, 251; 182/222, 91

[56] References Cited

U.S. PATENT DOCUMENTS 1,959,371 5/1934 Lamatsch ..... 101/220
2,910,937 11/1959 Hirschey ..... 101/228
3,288,060 11/1966 Miller ..... 101/153

FOREIGN PATENT DOCUMENTS 2741596 3/1978 Fed. Rep. of Germany ..... 101/228
2652977 5/1978 Fed. Rep. of Germany ..... 101/153
654777 3/1979 U.S.S.R. ..... 182/91

*Primary Examiner*—Edgar S. Burr
*Attorney, Agent, or Firm*—Jones, Tullar & Cooper

[57] ABSTRACT

An apparatus for shifting the paper web feed through a web-fed rotary printing press is disclosed. The paper web passing through the printing press contacts one or more fixed guide rollers and a shiftable guide roller carried at a free end of a pair of movable shifting bars. These shifting bars can be rotated about their fixed ends to shift the position of the shiftable guide roller and hence the paper web thus allowing access to portions of the printing press. A support platform is carried by the web shifting apparatus to provide a standing area for an operator or workman when the paper web is shifted out of its normal position.

3 Claims, 1 Drawing Figure

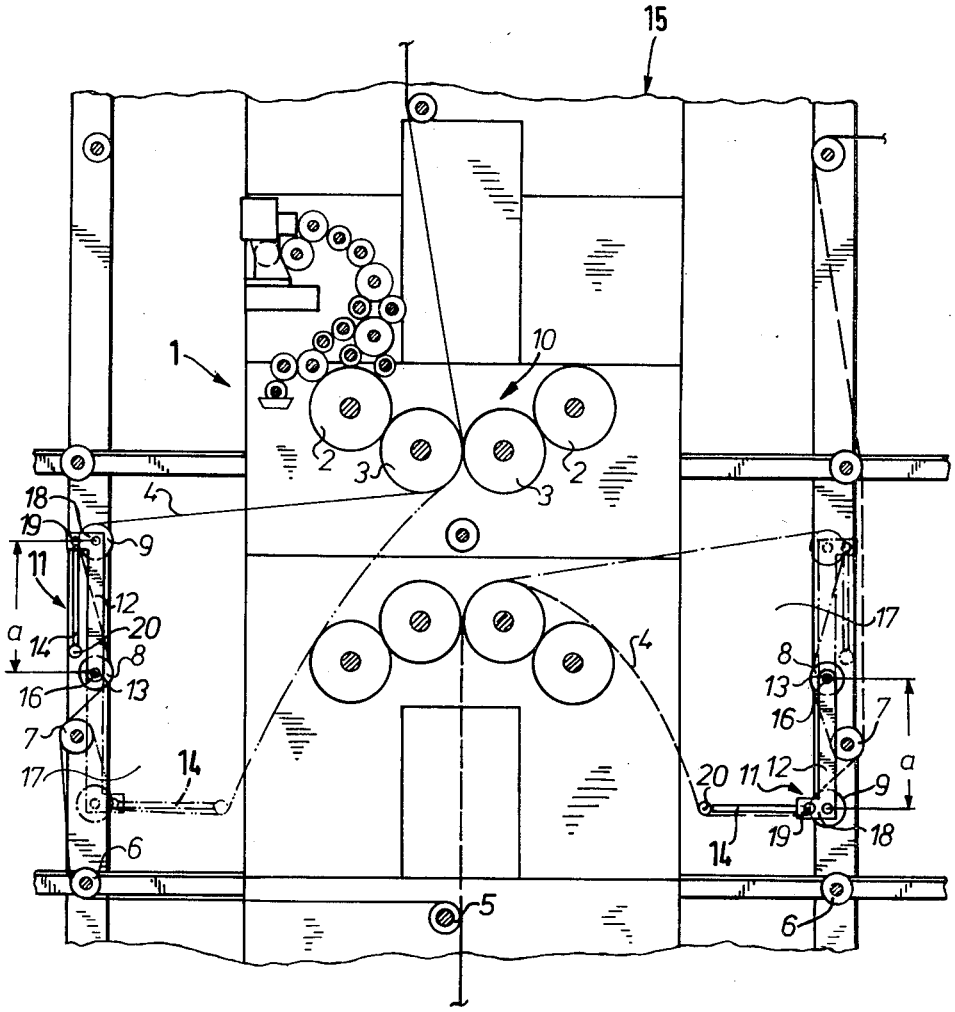
15
1
10
2
3
3
2
4
18
19
9
11
12
20
a
14
8
16
13
7
17
14
6
5
4
17
8
13
16
7
a
20
11
12
9
19
18
14
6

PAPER WEB SHIFTING APPARATUS

FIELD OF THE INVENTION

The present invention is directed generally to a paper web shifting apparatus for a web-fed rotary printing press. More particularly, the present invention is directed to a paper web shifting apparatus utilizing a shiftable guide roller. Most specifically, the present invention is directed to a paper web shifting apparatus in which the shiftable guide roller is carried at the free ends of spaced, rotatable shifting bars. The rotatable shifting bars are pivotably connected to the frame of the printing press and can move through 180° to shift the paper web's position to allow access to portions of the press normally inaccessible due to the position of the web. A suitable support platform is carried by the web shifting apparatus so that a workman can stand on the platform and work on the press when the web has been shifted.

DESCRIPTION OF THE PRIOR ART

A paper web shifting apparatus for use with a web-fed printing press is shown generally in German patent application No. 2,741,596. The paper web is shifted by means of a guide roller carriage which is caused to move vertically in the press frame. This carriage is also constructed as a platform for the press operator to stand on. In this device, it is necessary that the press operator be moved up and down while standing on the platform during paper web shifting. While this shifting is in progress, the cylinders of the rotary printing press should not be in motion, for reasons of safety.

SUMMARY OF THE INVENTION

It is an object of the present invention to provide a paper web feed shifting apparatus for a web fed rotary printing press.

A further object of the invention is to provide a paper web feed shifting apparatus including an operator support platform.

Another object of the invention is to provide a paper web feed shifting apparatus carrying a shiftable guide roller at the free ends of spaced shifting bars.

As will be discussed in greater detail hereinafter, the paper web feed shifting apparatus, in accordance with the present invention, is comprised of a shiftable guide roller which is rotatably carried at the first or free end of spaced shifting bars. These shifting bars are pivotably connected, at their second ends, to the side frames of the printing press. Suitable means are provided to rotate the shifting bars through 180° to move the shiftable guide roller and hence the paper web which passes over this guide roller. The shifting bars also carry, at their free ends, a platform assembly which can be swung out into a horizontal position to provide a working space for a workman or press operator.

The operator does not stand on the platform while the paper web is being shifted and thus the press can continue to run, if desired, while shifting is accomplished. The paper web shifting apparatus, in accordance with the present invention, allows the paper web to be shifted to allow access to portions of the printing press which would otherwise be blocked by the paper web. The paper web shifting apparatus, in accordance with the present invention, is durable, requires little space, operates efficiently, and enhances operator safety. Furthermore, no lifting platform is required to provide access to the portions of the printing press normally obstructed by the paper web.

BRIEF DESCRIPTION OF THE DRAWINGS

While the novel features of the paper web shifting apparatus, in accordance with the present invention, are set forth with particularity in the appended claims, a full and complete understanding of the invention may be had by referring to the description of a preferred embodiment as set forth hereinafter and as shown in the accompanying sole drawing figure which is a schematic side elevation view of a printing couple showing the paper web shifting apparatus, in accordance with the present invention, in both swung-in and swung-out positions, portions of the side frames of the printing press having been removed for clarity.

DESCRIPTION OF A PREFERRED EMBODIMENT

As may be seen in the drawing, an offset printing unit 1 is comprised of a printing couple 10 having suitable forme cylinders 2 and blanket cylinders 3. A paper web 4 passes between the blanket cylinders 3, and is printed in a known manner. It will be understood that the printing unit 1 is generally well known and conventional. The forme and blanket cylinders 2 and 3, respectively are suitable carried for rotation in side frames 15 of the press and are driven by conventional means (not shown).

Paper web 4 is fed to the printing couple 10 by means of fixed guide rollers 5, 6, 7, and 8 which are each rotatable and which are each secured to the press frame 15. A shiftable guide roller 9 is also provided since, as can be seen in the left side of the figure, access to the forme cylinder 2 on the left side of printing couple 10 is normally blocked by the paper web 4.

Shiftable guide roller 9 is carried by a paper guide roller shifting device, generally indicated at 11. The paper guide roller shifting device 11 is comprised of a pair of spaced shifting bars 12 which rotatably carry the shiftable guide roller 9 at a first or free end and which are each rigidly secured at a second end to a rotatable shaft 13 which passes through the side frames of the press. Paper guide roller 8 is carried on shaft 13, as may be seen in the drawing. Suitable means such as hydraulic or pneumatic cylinders or gear motors (not shown) may be used to rotate the shaft 13 and hence the shifting bars 12 and shiftable guide roller 9 through 180° about the axis of rotation 16 of shaft 13 from the 12 o'clock position shown in solid lines at the left of the figure to the 6 o'clock position shown in dashed lines at the left of the figure. The shifting bars 12 are given a dimension "a" which is less than the space or passage 17 between the side frames and the printing unit 1 so that the bars 12 can be rotated without interferring with the printing unit 1.

As may be seen most clearly in the right side of the figure, a platform 14 is supported by suitable bearings or journals 19 to shoulders 18 formed at the free ends of shifting bars 12. A paper web deflector roller 20 may be placed at the outboard end of platform 14. As soon as the paper guide roller shifting device 11 has been brought to its lower position, the platform may be swung down to its horizontal location so that the operator can stand on it. As may be seen in dashed lines at the left of the figure, the operation of the paper guide roller shifting device 11 causes the paper web 4 to be shifted down whereby the operator standing on platform 14 is afforded access to the forme cylinder 2 which had been blocked by the web 4. The operator can then work on forme cylinder 2 to perform such tasks as changing printing plates or the like.

While a preferred embodiment of a paper web feed shifting apparatus, in accordance with the present invention, has been fully and completely described hereinabove, it will be obvious to one of ordinary skill in the art that changes in, for example, the type of printing unit used, the number of guide rollers, the drive means for the shifting bars and the like could be made without departing from the true spirit and scope of the invention and that the invention is to be limited only by the following claims:

I claim:

1. A paper web feed shifting apparatus for shifting the path of paper web feed through a web-feed rotary printing press between a normal path in which portions of the press are inaccessible to a press operator and a shifted path which affords access to those normally inaccessible press sections, the press having at least one printing couple, said shifting apparatus comprising:

a plurality of fixed paper web guide rollers serially positioned for rotation in spaced side frames of the printing press and contacting the web before the web is fed to the printing couple when the web is in the normal path of paper web feed, the one of said fixed guide rollers which is positioned nearest to the printing couple in the direction of paper web feed being rotatably carried on a rotatable shaft secured in the side frames of the press; and a shiftable guide roller rotatably supported in first ends of spaced shifting bars, second ends of said spaced shifting bars being rigidly secured to said rotatable shaft for rotation therewith, said shifting bars being rotatable through an angle of about 180° to shift said shiftable guide roller and the paper web which is in contact with said shiftable guide roller between the normal and shifted paths whereby access to said normally inaccessible press sections is afforded the press operator by rotating said shifting bars to shift the web to the shifted path.

2. The paper web feed shifting apparatus of claim 1 further including a press operator support platform, said platform being pivotably supported at a first end by said first ends of said shifting bars and being capable of being placed in a horizontal position when said paper web is in its shifted path whereby the press operator can stand on said platform and is afforded access to said normally inaccessible press sections.

3. The paper web feed shifting apparatus of claim 2 wherein a paper web deflector roller is rotatably secured to a second end of said support platform.

* * * * *